US005613560A

United States Patent [19]

Jelinski et al.

[11] Patent Number: 5,613,560

[45] Date of Patent: Mar. 25, 1997

[54] WIRELINE SET, TUBING RETRIEVABLE WELL PACKER WITH FLOW CONTROL DEVICE AT THE TOP

[75] Inventors: Glenn Jelinski; Vitold P. Serafin; Bob B. Jones, all of Calgary, Canada

[73] Assignee: Site Oil Tools, Inc., Calgary, Canada

[21] Appl. No.: 430,818

[22] Filed: Apr. 28, 1995

[51] Int. Cl.[6] ..... E21B 23/06

[52] U.S. Cl. ..... 166/387; 166/125; 166/133

[58] Field of Search ..... 166/133, 135, 166/123, 125, 387, 181

[56] References Cited

U.S. PATENT DOCUMENTS

| | | | |
|---|---|---|---|
| 3,387,660 | 6/1968 | Berryman | 166/133 |
| 3,420,304 | 1/1969 | Kilgore | 166/133 |
| 3,631,925 | 1/1972 | Nutter | 166/134 |
| 4,185,689 | 1/1980 | Harris | 166/133 |
| 4,898,239 | 2/1990 | Rosenthal | 166/133 |
| 5,224,540 | 6/1993 | Streich et al. | 166/123 |
| 5,333,685 | 8/1994 | Gilbert | 166/123 |
| 5,449,040 | 9/1995 | Milner et al. | 166/382 |

FOREIGN PATENT DOCUMENTS 1286602 7/1991 Canada .

OTHER PUBLICATIONS

Baker "MAX" brochure of Baker Oil Tools, 1992, 6 pages.

Guiberson "Wireline Set VI Series Packers" brochure, 5 pages.

*Primary Examiner*—Hoang C. Dang

*Attorney, Agent, or Firm*—Oliff & Berridge

[57] ABSTRACT

A retrievable production packer is conditioned for initial wireline installation in a well utilizing an adapter comprising an outer sleeve and an inner rod connected to a mandrel carrying the slip assembly of the packer. The packer is frangibly supported in an initial transport condition for being set by means of a wireline setting device. A flow control device, such as a blanking plug, may be seated in the packer mandrel at the very top of the packer while being lowered into position and set with a wireline setting device. Thereafter, the tubing string may be connected to the packer downhole to release the packer and retrieve it from the well.

6 Claims, 7 Drawing Sheets

WIRELINE SET, TUBING RETRIEVABLE WELL PACKER WITH FLOW CONTROL DEVICE AT THE TOP

TECHNICAL FIELD

The invention generally relates to retrievable well packers which may be set by wireline and retrieved by tubing string.

BACKGROUND OF THE INVENTION

Well packers utilized for isolating a zone in a well below the packer from a zone above the packer for performing a well service operation such as acidizing, perforating, formation fracturing or pressure containment are known. Further, it is known to initially run a packer downhole to a selected position and to set the packer using wireline apparatus. After setting, the wireline is removed from the well and a tubing string is run down the well and attached to such packers for performing the well servicing operation. The packer can then be removed from the well by manipulation of the tubing string and pulling of the tubing string and packer. The packer can then be redressed and used again in the same well or at another location.

Flow through the packer must be prevented for a time in order to connect the tubing string and often to perform the service operation. In such situations, the packer is essentially used as a temporary bridge plug. Typically, in prior art devices, in order to seal off flow through the packer, a pump-out plug or flow control device is installed below the packer. A pump-out plug is subsequently removed by applying pressure through the tubing string to release the plug from the packer with the result that the pump-out plug is left behind as debris below the packer when the packer is removed. Other prior art devices utilize a flow control device, such as a blanking plug, installed in an accommodating profile at the bottom of the packer and later removed by wireline to allow flow through the packer. However, during service operations or connection of the tubing string, debris can accumulate in the bore of the packer above the blanking plug impairing its retrievability. Accordingly, it is desirable that the flow control device be located at the top of the packer. In known prior art tools, the flow control device is moved to the top of the packer by wireline after the packer is set and the tubing string is attached which requires an additional trip on wireline through the tubing string.

In one specific currently available retrievable packer, a tubular mandrel is connected to a wireline setting device through a wireline adaptor. A pair of slip assemblies and a sealing unit are mounted on the mandrel of the packer to allow the packer to be set in the well casing and to create a seal in the casing isolating a well zone below the packer from a well zone above it. A slick joint is mounted on the top of the mandrel having a plug receiving annular groove. The adaptor includes an elongated rod which is telescoped through the slick joint and a connecting means frangibly secures the bottom the rod in the joint recess where the slick joint and mandrel are threaded. The top of the rod is connected directly to a wireline setting device. A long sleeve attached to the housing of the wireline setting device rests on the top of the packer. A simultaneous application of force from the housing of the wireline setting device, through the sleeve, to the top of the packer in the downward direction and an upward pulling force on the connecting means provides relative motion between the slip assemblies and sealing unit, and the mandrel required to set the packer. However, since the rod extends through the slick joint past the plug receiving annular groove, it is not possible to seat a flow control device at the top of the mandrel.

A similar type of tool is disclosed in Canadian patent 1,286,602. The adaptor disclosed in that patent utilized for setting the packer includes a rod which is telescoped through the tool and frangibly secured to the bottom of the mandrel. In this tool, as in the previous one, the pump-out plug or flow control device must be located beneath the packer because the rod runs through the plug accommodating profile.

SUMMARY OF THE INVENTION

The present invention attempts to overcome the above-noted problems by providing an improved adaptor for use in running and setting a packer on wireline. Specifically, the present invention provides an adaptor, a wireline well packer setting assembly and a method for running and setting a well packer in a well by wireline with a flow control device seated at the top of the packer. More specifically, the present invention provides a unique adaptor enabling a flow control device to be seated at the top of the packer during installation on wireline and setting by a wireline setting device. Thereafter, with the wireline setting device and adaptor removed from the packer, production tubing or the like may be connected to the packer downhole, the flow control device may be removed from the packer by wireline through the tubing, and the packer may be subsequently released and retrieved from the well by manipulation and pulling of the tubing from the well.

Accordingly, the present invention provides an adaptor for use in setting a well packer by means of a wireline setting device with a flow control device removably seated at the top of said well packer and wherein said well packer is of the type including outer packer housings including slip assemblies and a sealing unit, and a tubular mandrel extending there through for relative movement therebetween to anchor said packer to the well casing and to create a seal in said casing, wherein said adapter comprises: (a) a first member engaged with said wireline setting device and an upper packer housing for applying a force in a first direction on said upper packer housing when said wireline setting device is actuated; and (b) a second member engaged with said wireline setting device and said mandrel for applying a force in a second direction opposite to said first direction, when said wireline setting device is actuated; and wherein (c) after said packer is engaged with said well casing and actuated to create said seal continued application of force by said wireline setting device causes said adaptor to disengage from said packer such that said adapter may be completely removed from said packer with said flow control device remaining seated at the top of said packer to inhibit flow through said tubular mandrel.

The present invention further provides a wireline well packer setting assembly for use in setting a well packer of the type including outer packer housings including slip assemblies and a sealing unit, and a tubular mandrel extending therethrough for relative movement therebetween to anchor said packer to the well casing and to create a seal in said casing comprising: (a) a wireline setting device; (b) an adaptor having: (i) a first member engaged with said wireline setting device and an upper packer housing for applying a force in a first direction on said upper packer housing when said wireline setting device is actuated; (ii) a second member engaged with said wireline setting device and said mandrel for applying a force in a second direction opposite to said first direction when said wireline setting device is actuated;

(c) a flow control device seated at the top of said well packer; and (d) wherein upon actuation of said wireline setting device, said well packer is engaged with said well casing and actuated to create said seal by relative movement between said packer housings and said mandrel and wherein continued application of force by said wireline setting device on said first and second members of said adaptor causes said adaptor to disengage from said packer such that said adaptor is completely removed from said packer with said flow control device remaining seated at the top of said packer to inhibit flow through said tubular mandrel.

The present invention further provides a method for setting a well packer having a tubular mandrel in the casing of a well by wireline and retrieving said packer by tubing string comprising: (a) removably seating a flow control device adapted to inhibit fluid flow inside the top end of said tubular mandrel; (b) connecting a wireline setting device to the end of a wireline; (c) releasably connecting said well packer to said wireline setting device; (d) running said well packer down said well to a selected position on said wireline; (e) actuating said wireline setting device to set said packer and to thereafter release said packer from said wireline setting device with said flow control device remaining seated at the top end of said packer; (f) connecting a tubing string to said packer; (g) engaging said flow control device by a wireline tool run through said tubing string, for removal and retrieval of said flow control device to allow uninhibited fluid flow through said tubular mandrel; and (h) retrieving said packer when it is no longer required downhole by manipulating said tubing string to disengage said packer and pulling the tubing string and packer to surface.

BRIEF DESCRIPTION OF THE DRAWINGS

The invention will be further described, by way of example, with reference to the following drawings wherein.

DETAILED DESCRIPTION

Figure 1A:
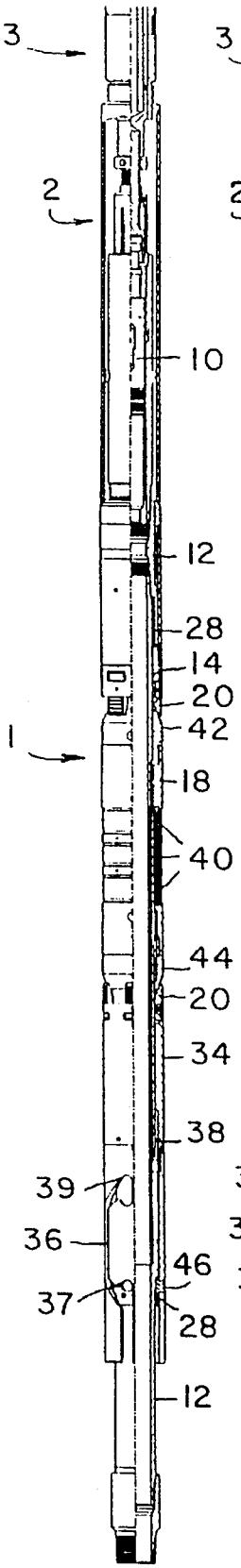
FIGS. 1(*a*)–1(*c*) are schematic illustrations of the operating principles of one embodiment of the invention, showing a packer being lowered into the well, being set and being retrieved from the well respectively.
Figure 1B:
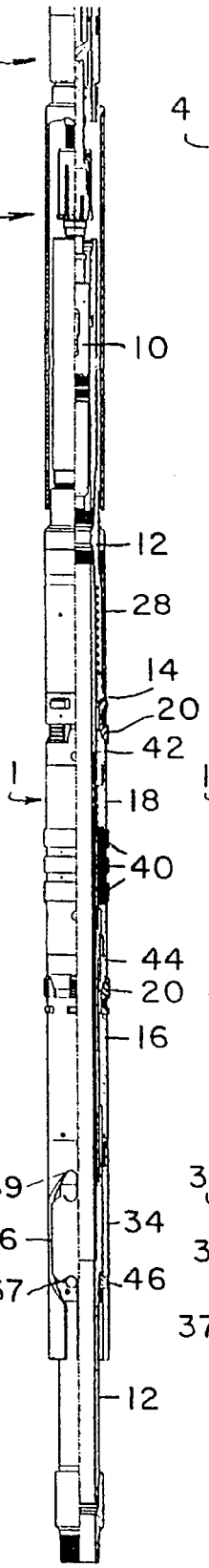
Figure 1C:
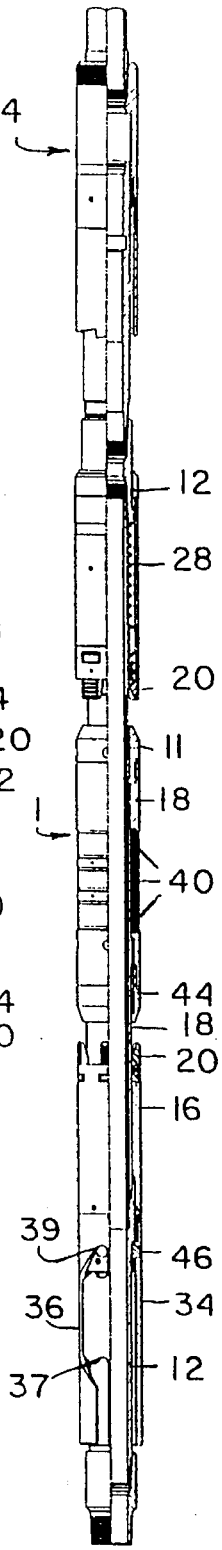

Referring to FIG. 1 which illustrates one embodiment of the present invention, a packer generally designated 1 is initially attached to an adaptor generally designated 2 which is in turn attached to a wireline setting device generally designated 3. FIG. 1(*a*) shows the packer 1, adaptor 2 and wireline setting device 3 as they would be when they are being run into the well on wireline (not shown). FIG. 1(*b*) shows the packer 1, adaptor 2, and wireline setting device 3 as they would be during setting of the packer. FIG. 1(*c*) shows the packer 1 attached to an on/off tool generally designated 4 which is in turn connected to a tubing string (not shown) with the packer shown disengaged from the well casing for retrieval from the well.

Generally, the packer 1 is run down the well on the wireline adaptor 2 which is in turn connected to the wireline setting device 3 such that, upon actuation of the wireline setting device 3, the packer 1 is anchored and actuated at a selected downhole position as a means of isolating the zone of the well below the packer from the zone above it. In FIGS. 1(*a*) and 1(*b*),a flow control device 10 is shown removably seated in a plug accommodating profile in a mandrel 12 of the packer 1. In FIG. 1(*c*), the flow control device 10 has been removed from the mandrel 12 of the packer 1.

The packer 1 includes the mandrel 12 and a number of outer packer housings including upper and lower slip assemblies 14, 16 and sealing unit 18.

Figure 5:
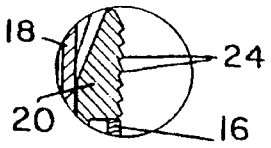
FIG. 5 is a schematic illustration of the slip elements and related components of the packer.
Figure 2A:
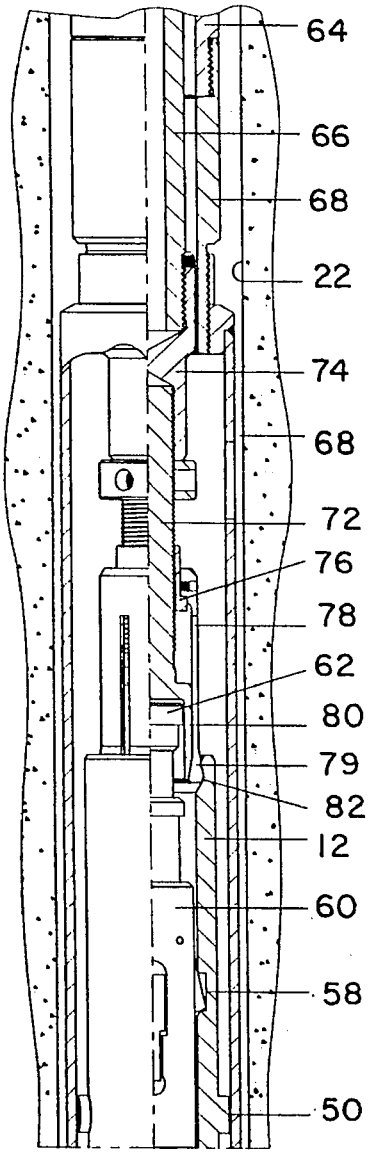
FIGS. 2(*a*)–2(*d*) are a cross-sectional and elevational view of a wireline well packer setting assembly and well packer shown as positioned as they would be when run into the well.
Figure 2B:
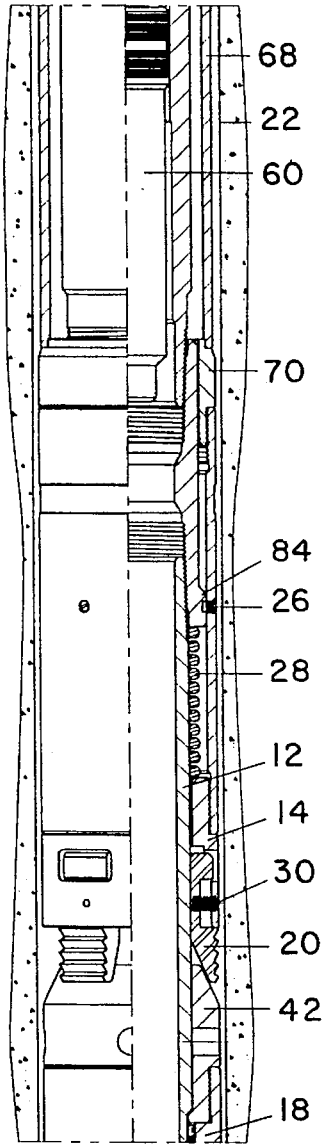
Figure 2C:
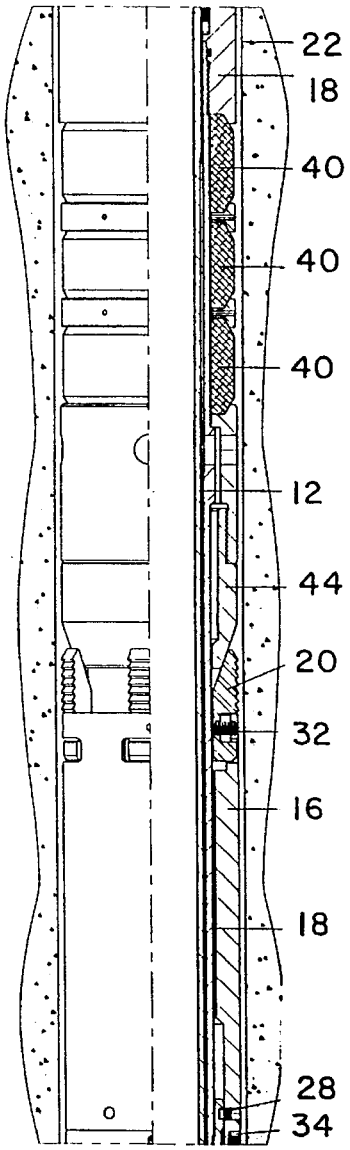
Figure 2D:
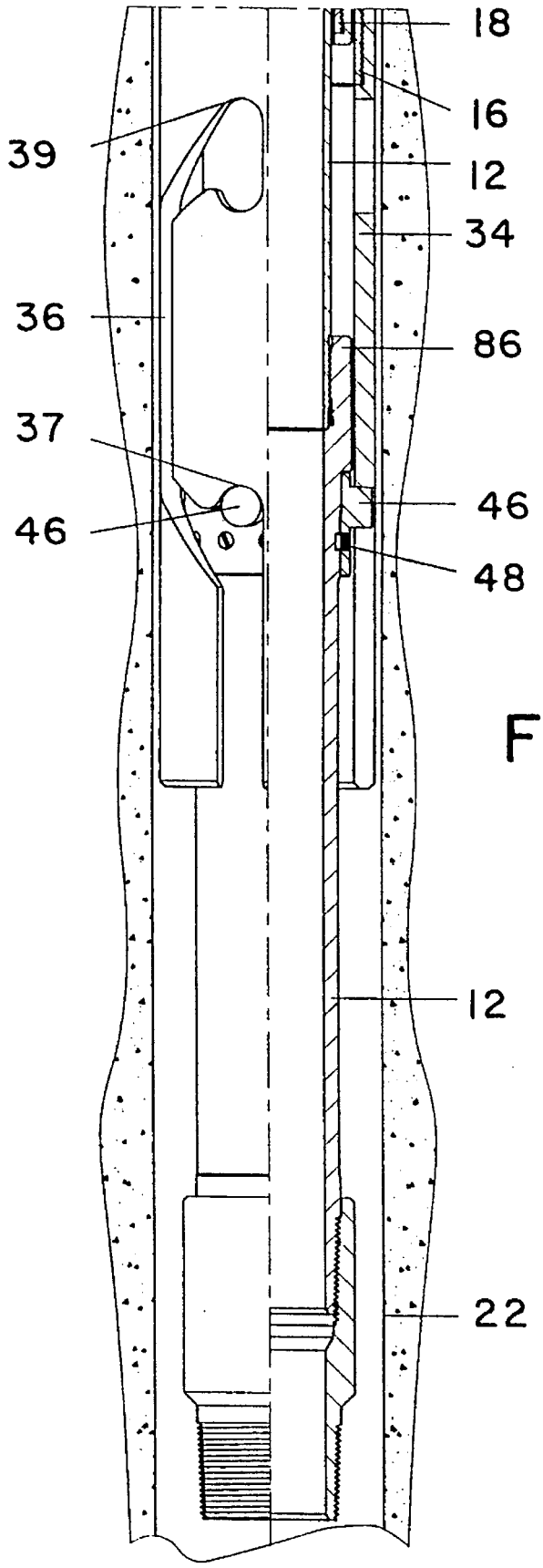
Figure 3A:
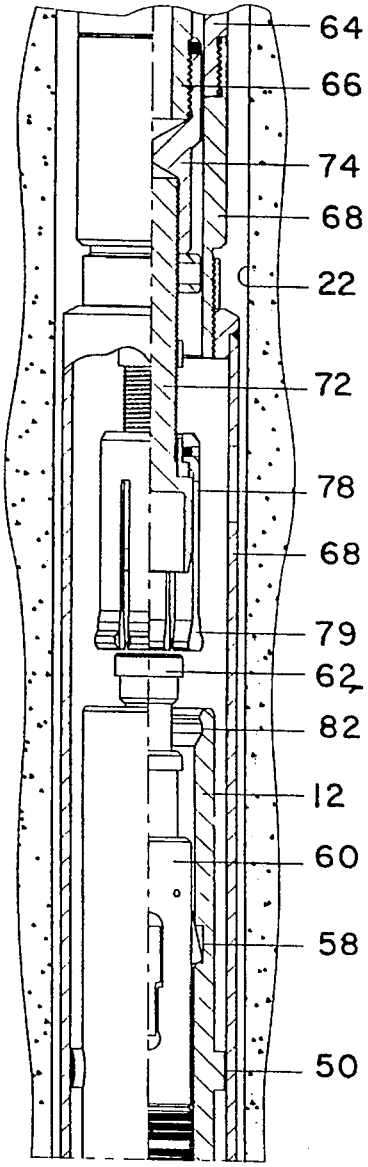
FIGS. 3(*a*)–3(*d*) are a cross-sectional and elevational view of the wireline well packer setting assembly and well packer with the packer shown installed in the well.
Figure 3B:
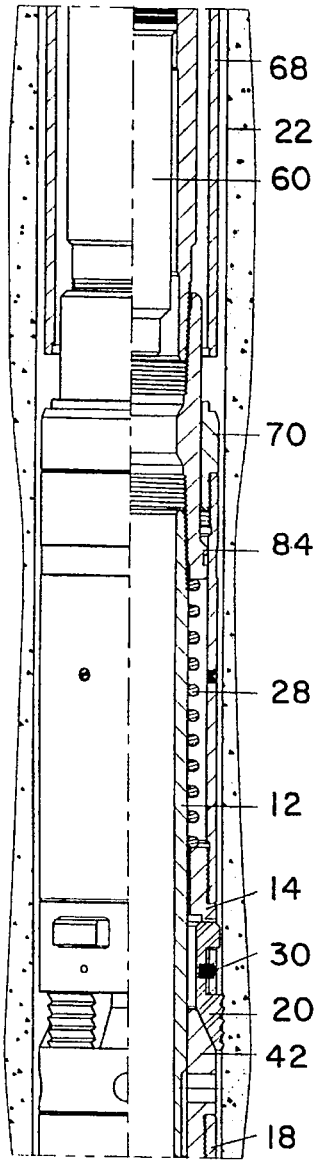
Figure 3C:
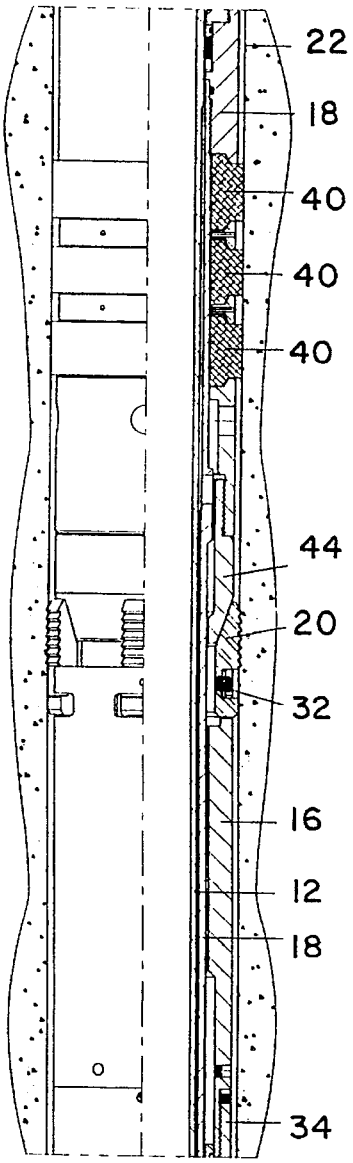
Figure 3D:
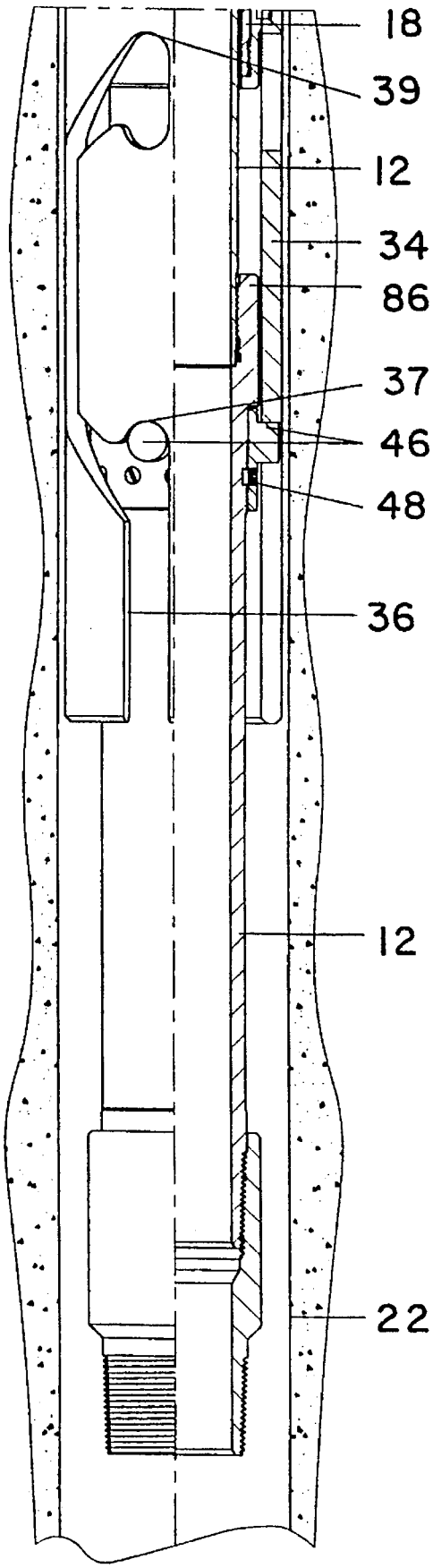
Figure 4A:
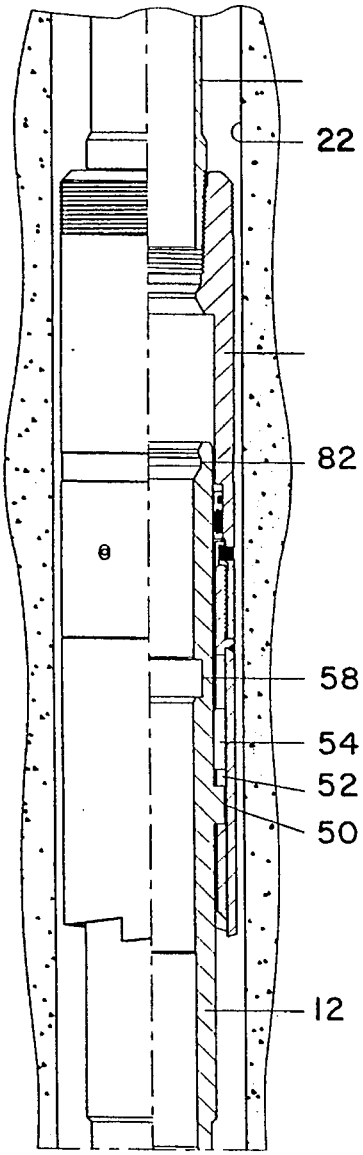
FIGS. 4(*a*)–4(*d*) are a cross-sectional and elevational view of the packer attached to a tubing string, the packer being positioned as it would be when it is being retrieved from the well.
Figure 4B:
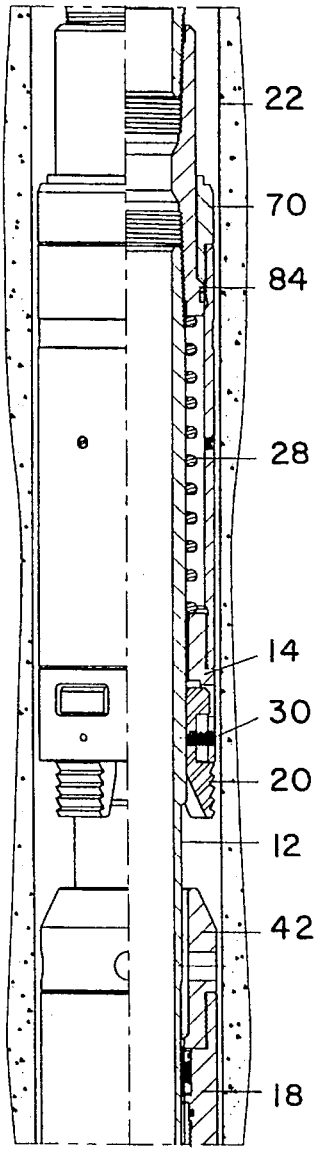
Figure 4C:
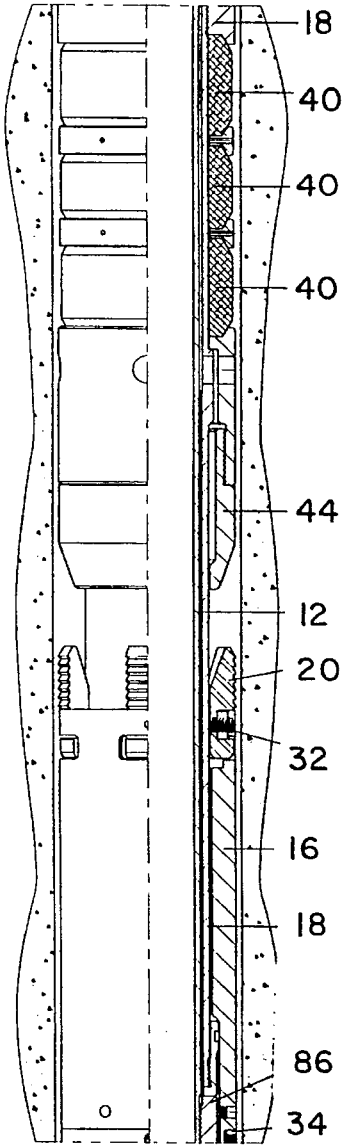
Figure 4D:
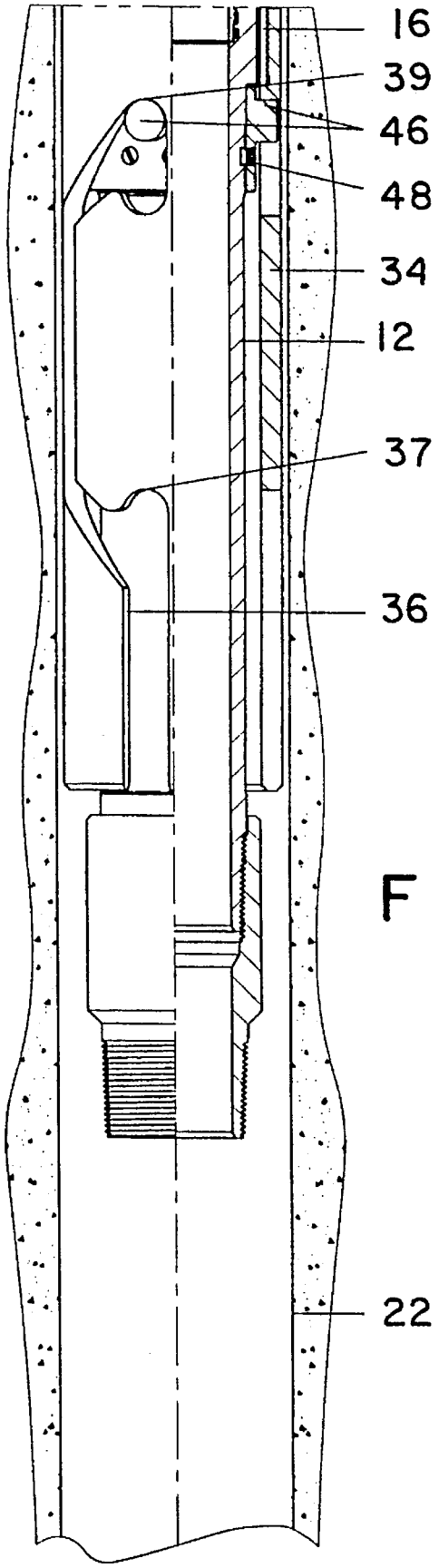

The upper and lower slip assemblies 14, 16 each include slip elements 20 (see FIG. 5) adapted to bite into the inside surface of the well casing 22 when engaged. The slip elements 20 on the upper slip assembly 14 are oriented such that the slip elements 20 bite into the inside surface of the well casing 22 to anchor the packer 1 against being pulled upwardly within the well. Similarly, the lower slip assembly 16 is oriented such that the slip elements 20 anchor the packer 1 against being pushed downwardly within the well.

Referring to FIG. 2(*b*), the upper slip assembly 14 is frangibly secured by means of shear screws 26 to the mandrel 12. A take up spring 28 is likewise frangibly secured to the mandrel 12 by the shear screws 26. Slip springs 30 are provided to urge the slip elements 20 of the upper slip assembly 14 into a retracted position in which they are held away from engagement with the casing 22. The take up spring 28 generally urges the upper slip assembly 14 downward but the slip assembly 14 is initially prevented from moving on the mandrel 12 by the shear screws 26.

The lower slip assembly 16 also includes slip elements 20, and those slip elements 20 are urged into retracted position away from engagement with the well casing 22 by means of slip springs 32. Connected to the lower slip assembly 16 is a jay housing 34 within which is formed a set of jay slots 36 each having a lower trap 37 and an upper trap 39. The lower slip assembly 16 and jay housing 34 are frangibly secured to the mandrel by means of shear screws 38.

The sealing unit 18 is located on the mandrel 12 between the upper and lower slip assemblies 14, 16. The sealing unit 18 includes elastomeric seals 40 which are adapted to be pressed against the inside surface of the casing 22 to seal the annular area between the packer 1 and the casing 22 when the packer 1 is actuated. The sealing unit 18 is connected to an upper cone 42 and a lower cone 44 which are free to move relative to the sealing unit 18. The cones 42, 44 are configured to engage the slip elements 20 to force the teeth 24 outwardly to engage the well casing 22 upon actuation of the packer 1.

A set of jay pins 46 are connected to the mandrel 12 by way of connecting means 48. The jay pins 46 and hence the mandrel 12 are free to ride within the jay slots 36 formed in the jay housing 34.

At the upper end of the packer, coupling pins 50 extend radially outward and are adapted to nest within a trap 52 of a connecting recess 54 in an on/off tool 4 attached to a tubing string 56 (see FIG. 4(*a*)).

The mandrel 12 of the packer 1 includes a flow control device receiving annular groove 58 at the top portion of the packer mandrel 12. A flow control device such as a blanking plug 60 is seated in the plug receiving annular groove 58.

The blanking plug 60 includes a prong 62 which extends upwardly above the top of the mandrel 12 when the blanking plug 60 is seated in the flow control device annular groove 58.

The blanking plug 60 is seated in the flow control device annular groove 58 during running of the packer 1 into the well and setting of the packer 1 by the wireline setting device 3.

The illustrated wireline setting device 3 is a device of the type well known in the art which is operated by means of an explosive charge (not shown). However, any known wireline setting device may be utilized within the ambit of the invention so long as it includes means for application of force in two different directions.

In the illustrated wireline setting assembly, the wireline setting device 3 includes a housing 64 and a plunger 66. An outer sleeve 68 of the adaptor 2 is connected to the housing 64 of the wireline setting device 3 and has a lower end resting on cap 70 of the upper slip assembly 14. A rod 72 of the adaptor 2 is connected to the plunger 64 of the wireline setting device 3 by means of rod adaptor 74. The rod 72 is in turn frangibly secured to the packer mandrel 12 by means of a shear collar 76 and a collet 78 including collet fingers 79. Specifically, the rod 72 includes a rod cone 80 located at the lower end of the rod 72 which forces the end of collet fingers 79 into engagement with recess 82 inside the top of the packer mandrel 12. The recess 82 is located above flow control device annular groove 58.

The shear collar 76 and rod 72 are telescoped through the collet 78 with the shear collar 76 initially firmly secured to the rod 72. As may be noted from FIG. 2(a), the rod cone 80 initially extends downwardly over the prong 62 and upper portion of the blanking plug 60.

In transport configuration of the packer (see FIGS. 2(*a*)–2(*d*)), the mandrel 12 is disposed in a lower position relative to the jay housing 34, with the jay pins 46 captured within the lower trap 37 of the jay slots 36 (see FIG. 2(*d*)). The upper slip assembly 14 and lower slip assembly 16 are held just touching the upper cone 42 and lower cone 44 respectively by the shear screws 26, 38. In this position, the packer 1 attached to the adaptor 2 which is in turn attached to the wireline setting device 3 are run down the well to a selected position.

Once located at the selected position, the wireline setting device 3 is actuated from surface by suitable means such as an electric charge sent down the wireline (not shown) causing a simultaneous application of force by the housing 28 through the sleeve 68 of the adaptor 2 to the cap 70 of the upper slip assembly 14 in a downward direction, and from the plunger 66 through the rod 32, shear collar 35 and collet fingers 79 to the mandrel 12 in an upward direction.

The upward force on the mandrel 12 pulls it upwardly causing the jay pin 46 connected to the mandrel 12 to pull upwardly on the jay housing 34 and lower slip assembly 16, breaking the shear screws 26. The slip elements 20 of the lower slip assembly 16 are then pushed onto the lower cone 44 forcing them from the retracted positions into their anchoring position wherein the teeth 24 bite into the well casing 22 and anchor the packer 1 from moving downwardly within the well. Similarly, the downward motion of the housing 64 shears the shear screws 26 and pushes the upper slip assembly 14 onto the upper cone 42 forcing the slip elements 20 of the upper slip assembly 14 into the casing 22. The take-up spring 28, being in a generally compressed condition, also urges the slip elements 20 of the upper slip assembly 14 onto the cone 42 ensuring that they engage the well casing 22 to anchor the packer 1 from moving upwardly within the well (see FIG. 3(*b*)). At the same time the sealing unit 18 is deformed such that the elastomeric elements 40 seal against the inside surface of the well casing 22 (see FIG. 3(*c*)).

Once the packer 1 is set in the well casing 22 with the sealing unit 18 deformed, continued setting force from the wireline setting device 3 shears the shear collar 76. As the wireline setting device 3 continues to stroke, the collet fingers 79 remain engaged in the recess 82 of the packer mandrel 12 while the rod 72 moves upward. Accordingly, the rod cone 80 is pulled from engagement with the collet fingers 79 and allows the collet fingers 79 to collapse and disengage from the mandrel 12. As seen in FIG. 3(*a*), the lower portion of the broken shear collar 76 and the collet 78 rest on the upper portion of the rod cone 80 so that they are retrieved along with the wireline setting device 3. Further, the wireline setting device 3 and adaptor 2 are completely released and removable from the packer 1 and may be retrieved from the well on the wireline (not shown) leaving the packer 1 behind with the blanking plug 60 seated in the flow control device annular groove 58 in the mandrel 12. This exposes the upper end of the packer and its coupling pins 50 for connection to the on/off tool 4 which is connected to the tubing string 56 (see FIG. 4(*a*)).

When it is desired to attach the packer 1 to the tubing string 56, the tubing string 56 with the on/off tool 4 connected to the end thereof is lowered onto the packer and the tubing string 56 is manipulated to latch the on/off tool to the coupling pins 50 of the packer.

After the tubing string 56 is attached to the packer 1 flow through the packer mandrel 12 and tubing string 56 may be reestablished by removal of the blanking plug 60 through standard wireline techniques.

When it is desired to retrieve the packer 1 from the well the slip assemblies 14, 16 must be released from their set position. In order to release the slip assemblies 14, 16 from their set position, the tubing string 56 and mandrel 12 are lowered slightly while applying torque to the tubing string 56. This shifts the jay pin 46 out of the lower trap 37 so that an upward pull on the tubing string 56 while maintaining the torque thereon causes the mandrel 12 to travel upwardly with the jay pin 46 riding within the jay slot 36 into the upper trap 39 (FIG. 4(*d*)). As the mandrel 12 is lifted, a shoulder 84 near the top of the mandrel lifts the upper slip assembly 14 off the upper cone 42 and slip springs 30 retract the slip elements 20 and release the force applied to the sealing unit 18 which returns to its undeformed condition (FIG. 4(*b*)). As the mandrel 12 continues moving upwards, a shoulder 86 on the lower portion of the mandrel 12 engages the bottom of the sealing unit 18, moving it upward which in turn lifts the lower cone 44 out from engagement with the lower slip elements 20 of the lower slip assembly 16 and slip springs 32 retract the lower slip elements 20 disengaging them from the well casing 22 (FIG. 4(*c*)). The tubing string 56 and the packer 1 may then be retrieved from the wall.

Those skilled in the art will recognize that the aforesaid description is by way of example only. Modifications may be made within the scope of the invention as set out in the appended claims.

We claim:

1. An adapter for use in setting a well packer by means of a wireline setting device with a flow control device removably seated at a top of the well packer and wherein the well packer is of the type including outer packer housings including slip assemblies and a sealing unit, and a tubular mandrel extending therethrough for relative movement therebetween to anchor the well packer to the well casing and to create a seal in the well casing, said adapter comprising:

(a) a first member engaged with the wireline setting device and an upper packer housing for applying a first force in a first direction on said upper packer housing when the wireline setting device is actuated, said first member including an outer sleeve connected to an outer housing of the wireline setting device and positioned to bear on a cap disposed at a top portion of said upper packer housing for applying a downward force in a downward direction on said upper packer housing; and (b) a second member engaged with the wireline setting device and the tubular mandrel for applying a second force in a second direction opposite to the first direction, when the wireline setting device is actuated, said second member including a rod having a first end attached to a plunger of the wireline setting device, and a second end including a cone, said cone being adapted to extend over a top of said flow control device which is seated in the tubular mandrel and to releasably engage the tubular mandrel for applying an upward force in an upward direction on the tubular mandrel until the well packer is engaged with the well casing and actuated to create the seal and to thereafter disengage from the tubular mandrel, said second member further including a shear collar on said rod and a collet having collet fingers attached to said shear collar, and said collet fingers extending downwardly adjacent said cone and being held in engagement with a recess on a top of the tubular mandrel by said cone until said shear collar shears and said cone is withdrawn, upon further upward movement of said cone said collet fingers collapsing inwardly and disengaging from said recess; whereby after the well packer is engaged with the well casing and actuated to create the seal, continued application of the upward force by the wireline setting device causes said adaptor to disengage from the well packer such that said adaptor may be completely removed from the well packer with the flow control device remaining seated at the top of the well packer to inhibit fluid flow through the tubular mandrel.

2. A wireline well packer setting assembly for use in setting a well packer of the type including outer packer housings including slip assemblies and a sealing unit, and a tubular mandrel extending therethrough for relative movement therebetween to anchor the well packer to a well casing and to create a seal in the well casing, comprising:

(a) a wireline setting device; and (b) an adaptor having:

(i) a first member engaged with said wireline setting device and an upper packer housing for applying a first force in a first direction on said upper packer housing when said wireline setting device is actuated, said first member includes an outer sleeve connected to an outer housing of said wireline setting device and positioned to bear on a cap at a top portion of said upper packer housing for applying a downward force in a downward direction on said upper packer housing; and (ii) a second member engaged with said wireline setting device and the tubular mandrel for applying a second force in a second direction opposite to the first direction when said wireline setting device is actuated, said second member including a rod having a first end attached to a plunger of said wireline setting device, and a second end including a cone, said cone being adapted to extend over a top of a flow control device which is seated in the tubular mandrel at a top of the well packer and to releasably engage the tubular mandrel for applying an upward force in an upward direction on the tubular mandrel until the well packer is engaged with the well casing and actuated to create the seal and to thereafter disengage from the tubular mandrel, said second member further including a shear collar on said rod and a collet having collet fingers attached to said shear collar, said collet fingers extending downwardly adjacent said cone and being held in engagement with a recess on a top of the tubular mandrel by said cone until said shear collar shears and said cone is withdrawn, upon further upward movement of said cone said collet fingers collapsing inwardly and being disengaging from said recess, whereby upon actuation of said wireline setting device, the well packer is engaged with the well casing and actuated to create the seal by relative movement between the packer housings and the tubular mandrel and whereby continued application of the upward force by said wireline setting device on said first and second members of said adaptor causes said adaptor to disengage from the well packer such that said adaptor is completely removed from the well packer with said flow control device remaining seated at the top of the well packer to inhibit fluid flow through the tubular mandrel.

3. A wireline well packer setting assembly according to claim 2, wherein said flow control device is seated in an annular groove inside the tubular mandrel located below said recess on the top of the tubular mandrel whereby said flow control device includes an upper portion having a diameter less than that of said cone which extends out of the top of the tubular mandrel.

4. A method for setting a well packer having a tubular mandrel in a casing of a well by a wireline and retrieving the well packer by a tubing string, comprising the steps of:

(a) removably seating a flow control device adapted to inhibit fluid flow inside a top end of the tubular mandrel;

(b) connecting a wireline setting device to an end of the wireline;

(c) releasably connecting the well packer to said wireline setting device;

(d) running the well packer down the well to a selected position on the wireline;

(e) actuating said wireline setting device to set the well packer and to thereafter release the well packer from said wireline setting device with said flow control device remaining seated at a top of the well packer;

(f) connecting the tubing string to the well packer;

(g) engaging said flow control device by a wireline tool run through the tubing string, for removal and retrieval of said flow control device to allow uninhibited fluid flow through the tubular mandrel; and (h) retrieving the well packer when desired by manipulating said tubing string to disengage the well packer and pulling the tubing string and the well packer to surface whereby an adaptor is used to connect the well packer to said wireline setting device, said adaptor comprising:

(i) a first member engaged with said wireline setting device and an upper packer housing of the well packer for applying a first force in a first direction on said upper packer housing when said wireline setting device is actuated, said first member including an outer sleeve connected to an outer housing of said wireline setting device and positioned to bear on a cap at a top of said upper packer housing for applying a downward force in a downward direction on said upper packer housing; and (ii) a second member engaged with said wireline setting device and the tubular mandrel for applying a second force in a second direction opposite to the first direction when said wireline setting device is actuated, said second member including a rod having a first end attached to a plunger of said wireline setting device, and a second end including a cone, said cone being adapted to extend over a top of said flow control device which is seated in the tubular mandrel and to releasably engage the tubular mandrel for applying an upward force in an upward direction on the tubular mandrel until the well packer is engaged with the well casing and actuated to create the seal and to thereafter disengage from the tubular mandrel, said second member further including a shear collar on said rod and a collet having collet fingers attached to said shear collar, said collet fingers extending downwardly adjacent said cone and are held in engagement with a recess on a top of the tubular mandrel by said cone until said shear collar shears and said cone is withdrawn, whereupon said collet fingers collapse and are removable upon further upward movement of said cone, and whereby, after the well packer is set, continued application of the upward force by said wireline setting device causes said adaptor to disengage from the well packer such that said adaptor may be completely removed from the well packer with said flow control device remaining seated in the top end of said the tubular mandrel.

5. A method according to claim 4, wherein said flow control device is seated in an annular groove inside the tubular mandrel located below said recess on the top of the tubular mandrel, and wherein said flow control device includes an upper portion having a diameter less than that of said cone which extends out of the top of the tubular mandrel.

6. A method according to claim 4, wherein said collet fingers collapse inwardly.

* * * * *